US005850986A

United States Patent [19]

Alexander, Jr.

[11] Patent Number: 5,850,986

[45] Date of Patent: Dec. 22, 1998

[54] REUSABLE PAPER-ROLL CORE-CHUCK WITH INTERCHANGEABLE FINS

[76] Inventor: James E. Alexander, Jr., Box 464A, Greenfield Rd., Greenfield, Me. 04423

[21] Appl. No.: 904,146

[22] Filed: Jul. 31, 1997

[51] Int. Cl.[6] ..... B65H 18/04

[52] U.S. Cl. ..... 242/596.7

[58] Field of Search ..... 242/570, 571, 242/571.3, 571.4, 571.5, 576.1, 596.7, 597.5, 597.6, 599, 599.4, 613.2, 613.5

[56] References Cited

U.S. PATENT DOCUMENTS

| | | | |
|---|---|---|---|
| 2,585,999 | 2/1952 | Bunch | 242/571 |
| 3,396,918 | 8/1968 | Adamson et al. | 242/571 |
| 3,722,929 | 3/1973 | Gilman | 242/571.5 |
| 3,806,140 | 4/1974 | Robertson | 269/48.1 |
| 4,783,016 | 11/1988 | Pool | 242/571.4 |
| 5,299,751 | 4/1994 | Pichlmair et al. | 242/596.7 |
| 5,492,280 | 2/1996 | Corres et al. | 242/571.4 |

FOREIGN PATENT DOCUMENTS

| | | | |
|---|---|---|---|
| 1447617 | 8/1976 | United Kingdom | 242/576.1 |

*Primary Examiner*—John M. Jillions
*Attorney, Agent, or Firm*—Thomas L. Bohan and Associates

[57] ABSTRACT

A core-chuck device having reusable parts as well as replaceable interchangeable-fins for use within the field of large-scale paper, film, or foil manufacturing. The reusable core-chuck device provides a versatile and lightweight core-chuck of plastic material, where the outermost diameter of the core-chuck can be modified by replacement of radially spaced interchangeable-fins of varying sizes on the core-chuck. The interchangeable-fins are matingly securable within the central-hub of the core-chuck device. The inner-core of the central-hub contains a metallic element that enables mechanical handling of a paper-roll having one core-chuck device inserted into each end of the paper-roll core. An optional end-cap is also included which secures the interchangeable-fins from longitudinal movement with respect to one another. The core-chuck device results in a cost-effective alternative to prior-art devices.

20 Claims, 6 Drawing Sheets

REUSABLE PAPER-ROLL CORE-CHUCK WITH INTERCHANGEABLE FINS

BACKGROUND OF THE INVENTION

1. Field of Invention

The present invention relates to the field of large-scale paper manufacturing. More particularly, the present invention relates to a device for providing a versatile and reusable paper-roll core-chuck with interchangeable fins.

More particular yet, the present invention involves a lightweight core-chuck, where the outermost diameter of the core-chuck can be modified by replacement of azimuthally spaced fins of varying sizes on the core-chuck. The inner-core of the core-chuck contains a metallic element that enables mechanical handling of a paper-roll having one core-chuck inserted into each core of the paper-roll.

2. Description of Prior Art

During large-scale paper manufacturing, the generation and use of very large rolls of paper is common. Indeed, these paper-rolls can be massive—reaching several feet in diameter and weighing upwards of twenty thousand pounds (9000 kilograms). In working with these paper-rolls, it is necessary to create solid points of rotation. These points of rotation are at the ends of the core of the paper-roll. Some additional mechanism is added at each end to allow handling and rotation of the paper-roll. That additional mechanism is commonly referred to as a core-chuck. Placement of a core-chuck into each end of the hollow center of the paper-roll provides a way to handle the paper-roll during manufacturing of various paper products. Further, when the paper-roll is rotating at a high rate, it is important that a firm connection exists between each core-chuck and the inner dimension of each end of the paper-roll.

Conventional core-chucks either constitute a solid hub or, more commonly, a central hub formed with radial projections. FIG. 1 shows, within a paper-roll 13, a prior-art core-chuck of the type having a central hub 10 and radial projections 11. The common central-hub 10 with radial projections 11 is lighter in weight than the solid hub (not shown). However, the radial projections 11 are typically welded or otherwise caused to adhere to the central hub 10 in a permanent manner. Because paper-rolls are formed in a variety of standard and non-standard sizes, the hollow axis of paper-rolls also varies. As conventional core-chucks are of fixed dimensions and therefore lack adjustability, the versatility of such a conventional core-chucks is significantly reduced. This is because multiple core-chucks must be kept on hand by the manufacturer for handling any size of paper-roll that may be used at any given moment. More importantly, the conventional core-chuck having a central hub 10 formed with radial projections 11 experience extensive wear at the connection 12 between the central hub 10 and each radial projection 11. That connection 12 is usually made via welding or a robust adhesive. However, heavy use typically weakens the connection 12 to the point of failure or at least to the point where costly replacement of the entire core-chuck is needed. Additionally, the entire radial projection or just its end can become excessively worn.

In the field of large-scale paper manufacturing, there have been attempts to overcome the lack of adjustability within core-chucks. In general, the complexity of such efforts has undercut whatever advantages they might otherwise offer. Indeed, the time and effort involved in using complex and inefficient adjustable core-chuck devices is self-defeating. Various ways of adjusting a core-chuck to the inner dimension of a paper-roll core include providing deformable chuck surfaces, bladder chucks, and bladder shafts. As before, such prior-art core-chucks are subject to excess wear necessitating replacement of the entire device. Other prior-art core-chucks have their own disadvantages.

One prior-art core-chuck device is that of Montalvo (U.S. Pat. No. 5,326,113), and involves a relatively complex fluid-actuated core-chuck. A pneumatic-compression ram moves a cam to force jaws outwardly to engage the inner diameter of the paper-roll. While this prior-art device is adjustable, it is not easily serviced and is very costly to replace. Other such cam-actuated core-chucks exist that are deficient for the same reasons as is the Montalvo device. In addition to excessive cost and waste, a general defect of prior-art core-chucks with inner cam structures is the added weight. Inherent to core-chucks is the requirement that they be moved often. This poses lifting hazards to the individuals who perform this work. Overall, as complexity of the prior-art core-chucks increase, so does their weight and, relatedly, so does the laborer's hazards.

Accordingly, the prior art fails to provide any core-chuck device suitable for current paper manufacturing demands. Therefore, what is needed is a core-chuck device that is lightweight and easy to use. What is also needed is such a device that provides a high degree of versatility such that it can be used within paper-rolls of various sizes. Further, what is needed is such a device that is both simple and durable. Still further, what is needed is such a device that is cost-effective in that only the parts that actually wear out are required to be replaced and are so replaced efficiently and cheaply.

SUMMARY OF THE INVENTION

It is an object of the present invention to provide a core-chuck device that meets or exceeds current paper manufacturing demands. Another object of the present invention is to provide a lightweight, easy-to-use core-chuck device that has a high degree of versatility such that it can be used within variously sized paper-rolls. Yet another object of the present invention is to provide a core-chuck device that is fabricated in a minimal amount of parts and from a sufficiently durable material. Still another object of the present invention is to provide a core-chuck device that is cost-effective in that some parts are standardized and some parts are variable such that only the variable parts that actually wear out are required to be replaced and are so replaced quickly and at a very low cost.

The core-chuck device of the present invention includes a reusable hub-section with interchangeable fins projecting radially around the hub-section. An end-cap is also provided that serves to maintain the fins uniformly around the hub-section. Although, this discussion focuses on use of the present invention in the field of paper manufacturing, any similar field such as film or foil manufacturing would also benefit from the present invention. Also, for purposes of illustration, the present invention is discussed in terms of plastic parts and metallic parts; however, it should be understood that the innovative core-chuck device presented herein is not intended to be limited to fabrication by any particular method of any particular materials. The invention may be fabricated in a variety of ways including, but not limited to, casting, extrusion, or machining and may be fabricated from a variety of lightweight but durable materials including, but not limited to, high-impact plastic, ultra-high molecular weight (UHMW) plastic, aluminum, aluminum-alloys, or any other suitably durable materials.

More specifically, the core-chuck device of the present invention includes a relatively straightforward design having only four major types of parts. Three of these part-types are designed to be reused, while one type of part (i.e., the interchangeable-fins) is designed to be replaceable upon becoming worn out or upon changing the paper-roll core size. The other three part-types are, respectively, a central-hub, an end-cap, and a support-element. The support element is made from a metallic material while the central-hub, end-cap, and interchangeable-fins are each made from a plastic material. In general, the support-element is of a metallic material because the support-element is the point of attachment where manufacturing equipment grasps or supports each core-chuck device within the paper-roll and thus provides secure handling of the paper-roll. It is the tips of each interchangeable-fin that grasp the inner-surface of the paper-roll core at each end of the paper-rolls.

It is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

DETAILED DESCRIPTION OF THE PREFERRED EMBODIMENT

Figure 1:
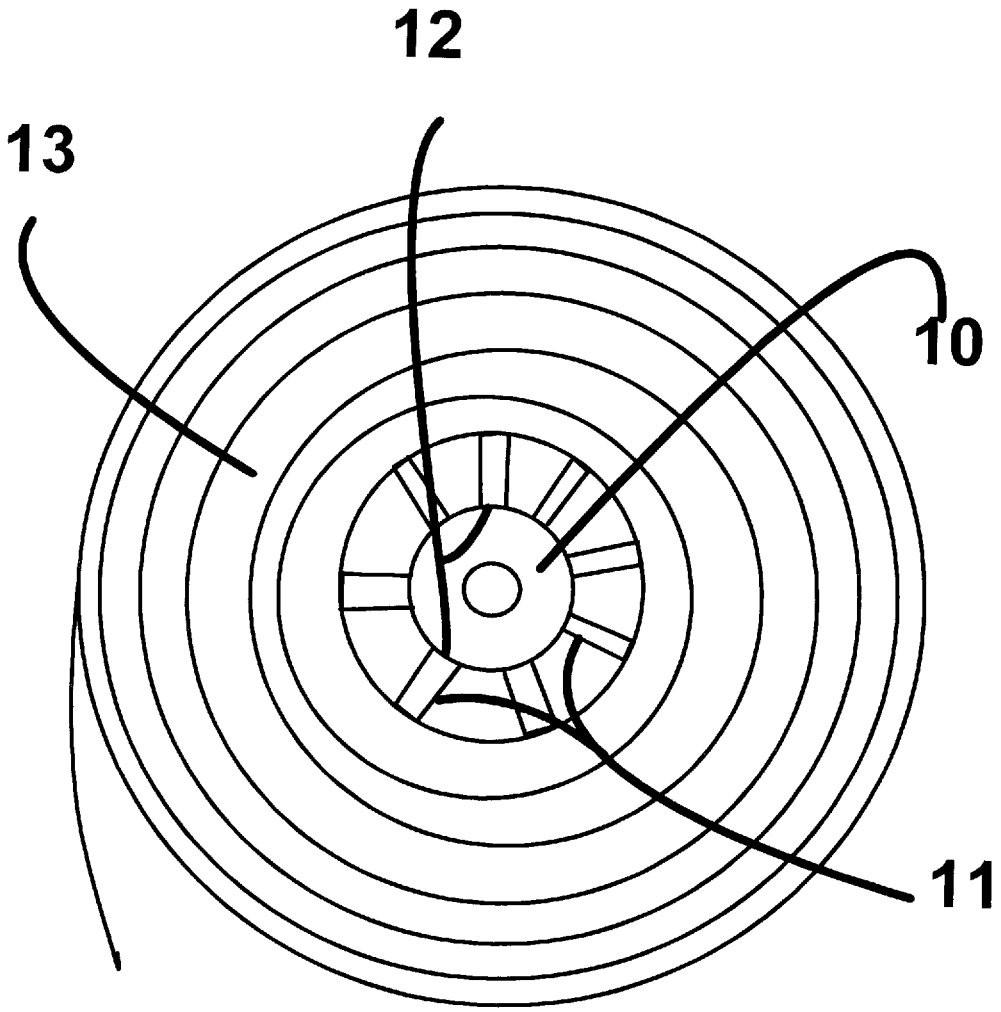
FIGURE 1 (Prior Art)
FIG. 1 is a side view of a prior-art core-chuck shown within a paper-roll core.
Figure 2:
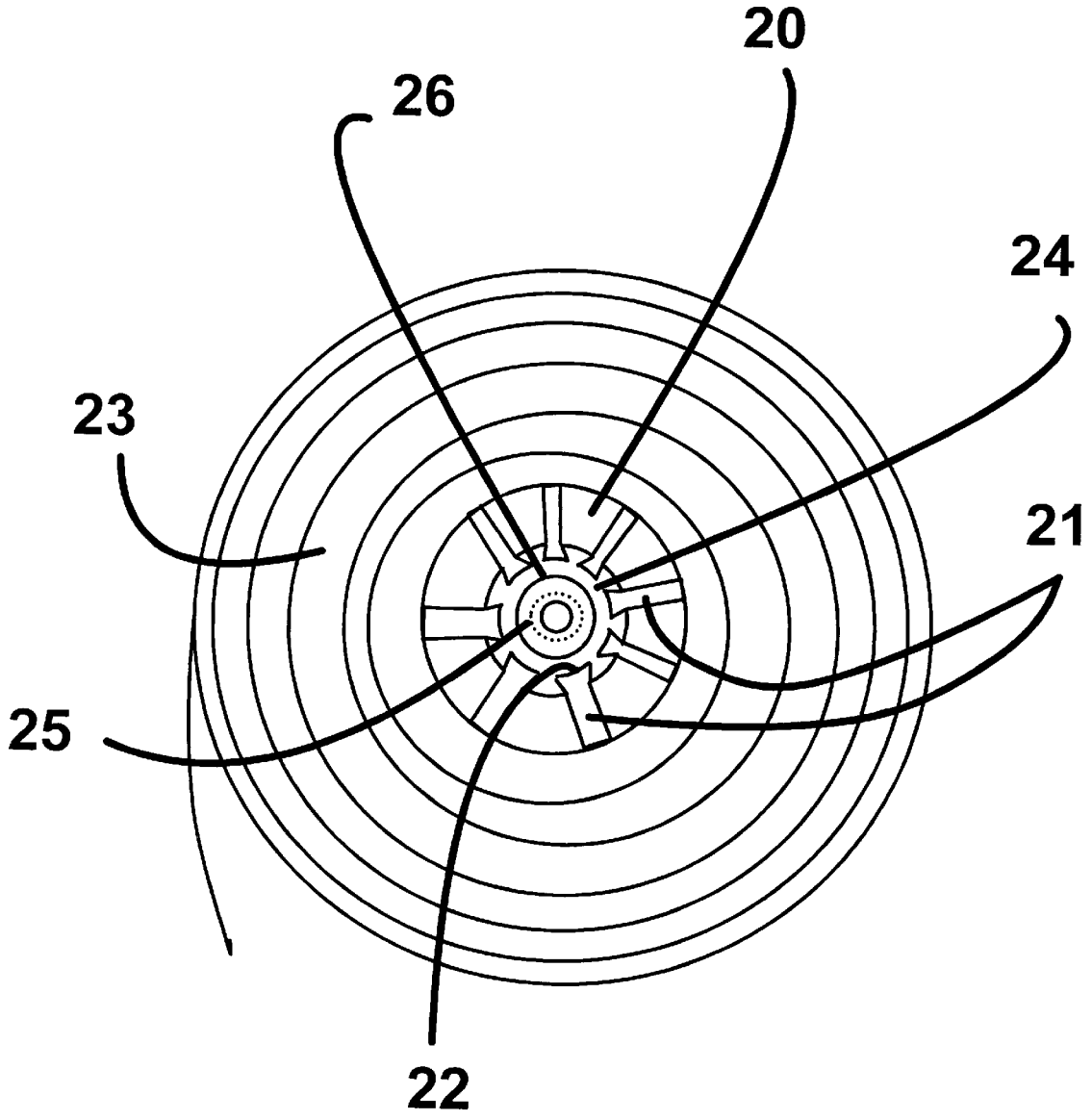
FIG. 2 is a side view of a core-chuck device according to the preferred embodiment of the present invention shown within a paper-roll core.

In FIG. 2, a core-chuck device 20 is shown according to the preferred embodiment of the present invention placed within an end of a core of a paper-roll 23. The core-chuck device 20 includes a central-hub 24 with a plurality of interchangeable-fins 21 located about the central-hub 24 in a radially-outward-projecting manner. Both the central-hub 24 and the interchangeable-fins 21 are preferably made from plastic material such as NYLON because of such material's lightweight attributes. However, the plastic material should also be preferably a high density plastic such as UHMW polymers so as to withstand the great forces created by the weight of the paper-roll 23. A support-sleeve 26 having a flange 27 is placed within a core-chuck-aperture 25 (shown by dotted lines). The support-sleeve 26 is preferably made from aluminum because of its durable, lightweight properties.

Figure 3:
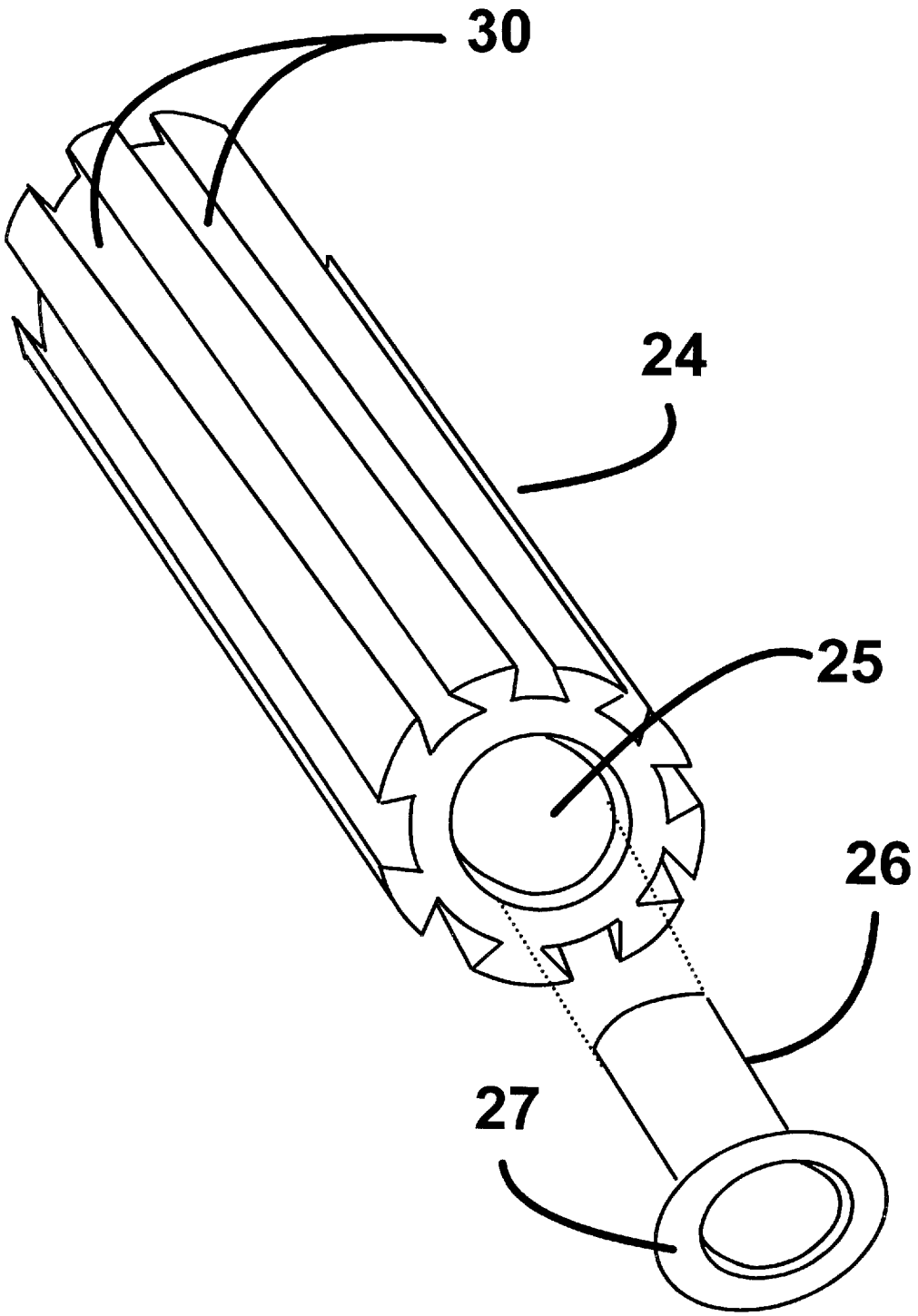
FIG. 3 is a perspective view of the central-hub of the core-chuck device according to the present invention showing the dovetail-shaped channels located therein.

In FIG. 3, the central-hub 24 is shown with respect to the support-sleeve 26. Within the outermost surface of the central-hub 24 are located longitudinally oriented channels 30. Each channel 30 is a dovetail-shape that widens from the outermost surface of the central-hub 24 towards the central-hub-aperture 25. The support-sleeve 26 is shown for placement by way of an interference-fit within the central-hub-aperture 25.

Figure 4:
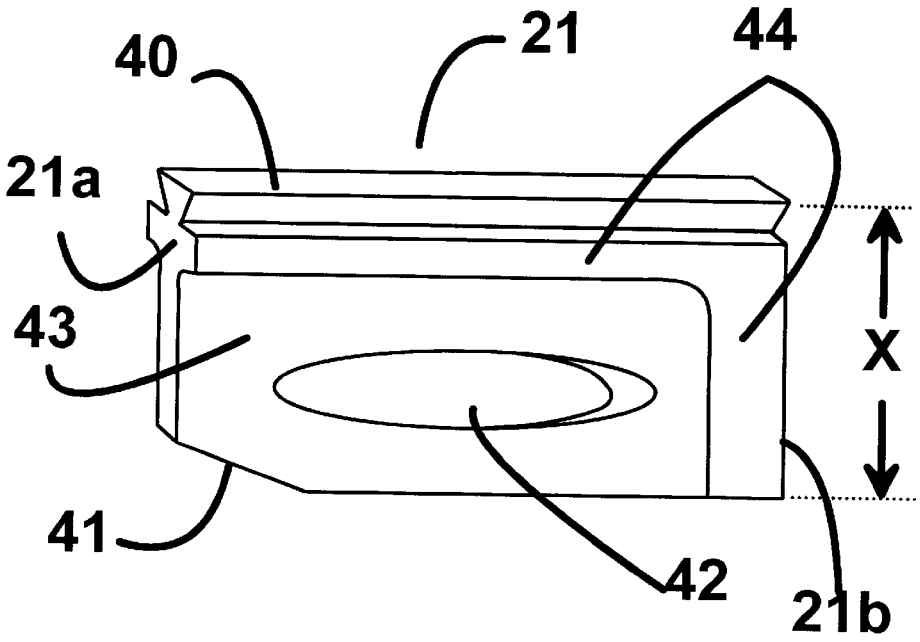
FIG. 4 is a perspective view of one of the interchangeable-fins of the core-chuck device according to the present invention showing the dovetailing of a longitudinal edge of the interchangeable-fin.
Figure 4A:
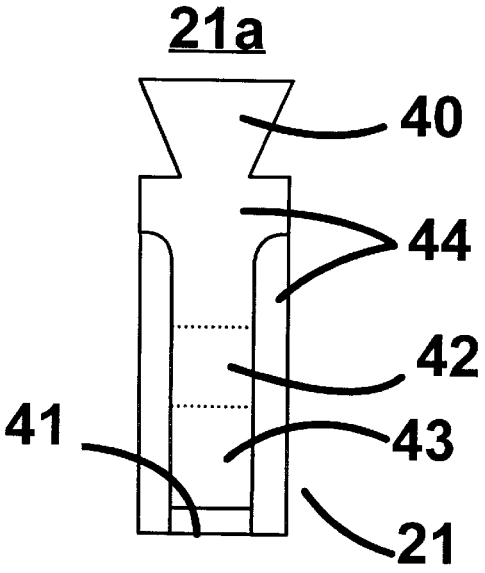
FIGS. 4*a* and 4*b* are end views of opposing ends of the interchangeable-fins as shown in FIG. 4 showing further details of the dovetailing of the longitudinal edge of the interchangeable-fin.
Figure 4B:
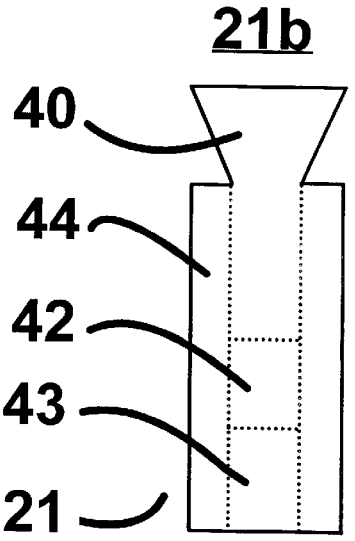
Figure 5:
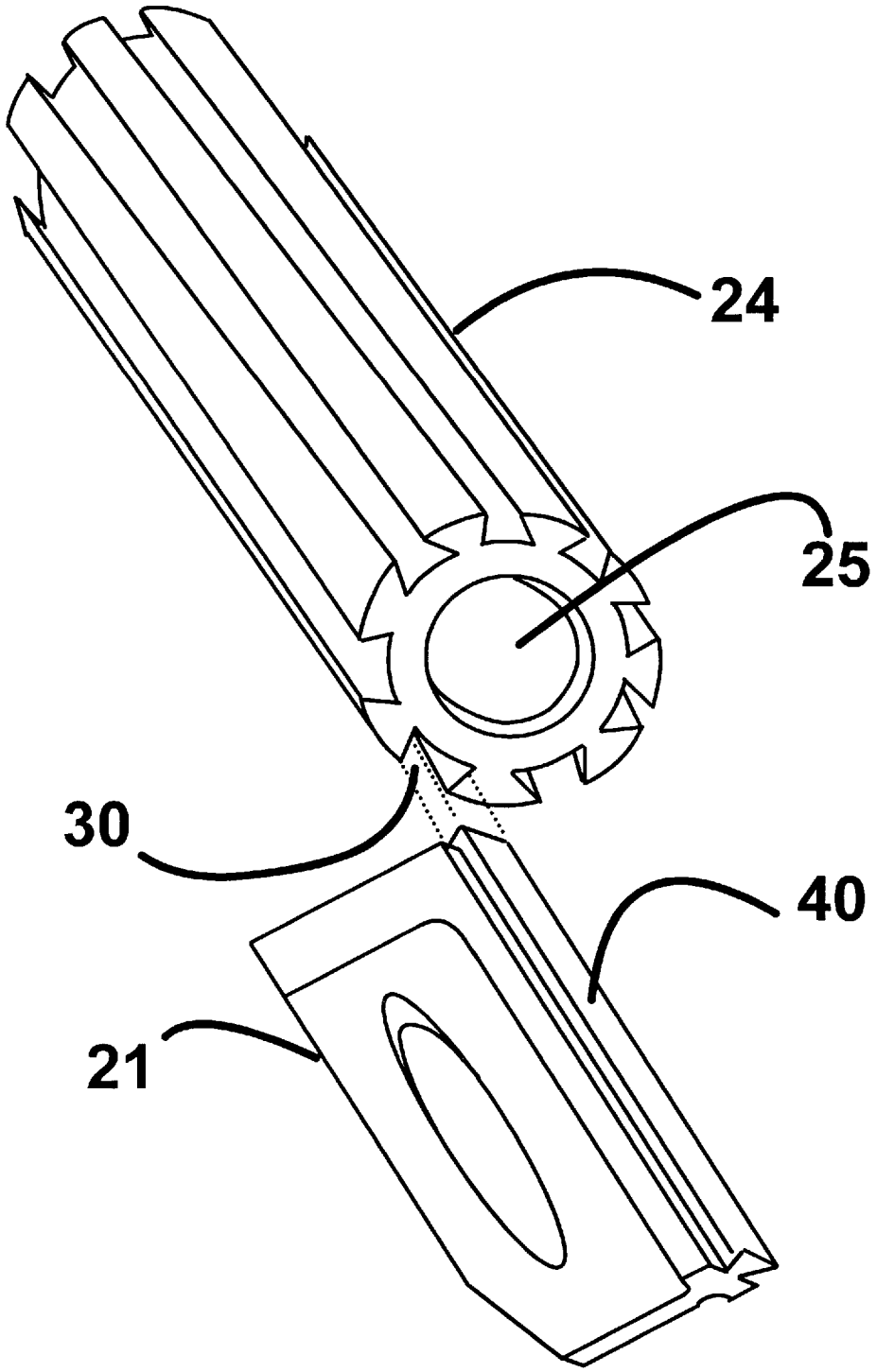
FIG. 5 is a perspective view of the core-chuck device according to the present invention showing the dovetail connection of an interchangeable-fin, as shown in FIG. 4, with the central-hub, as shown in FIG. 3.

In FIG. 4, one of the interchangeable-fins 21 is shown in greater detail. Each interchangeable-fin 21 includes a longitudinally oriented protrusion 40 in a dovetail-shape that inversely corresponds to each channel 30 in the central-hub 24 such that a sliding relationship is made as seen in FIG. 5. Each interchangeable-fin 21 is made from a plastic material (e.g., NYLON) that is preferably a high-impact plastic. In order to decrease the mass and thus decrease the weight of the present invention, each interchangeable-fin 21 includes a thinned-section 43 and a hollowed-out-section 42. However, a thickened-section 44 remains and maintains the structural integrity of each interchangeable-fin 21. The frontal-side 21*a* of each interchangeable-fin 21 includes a tapered section 41 which enhances (as a sort of self-seating feature) initial entry of the core-chuck device as a whole into the paper-roll. Also, the hollowed-out-section 42 functions as a useful gripping area for a laborer's hands. By altering the width X in fabrication, any desired paper-roll core dimension can be matched by a given set of interchangeable-fins 21. By producing different sets of interchangeable-fins 21 in a variety of standard or non-standard (i.e., customized) widths X, the core-chuck device of the present invention can be used in may different paper-rolls by changing only the interchangeable-fins 21. FIGS. 4*a* and 4*b* detail further the frontal-side 21*a* and base-side 21*b*, respectively.

Figure 6:
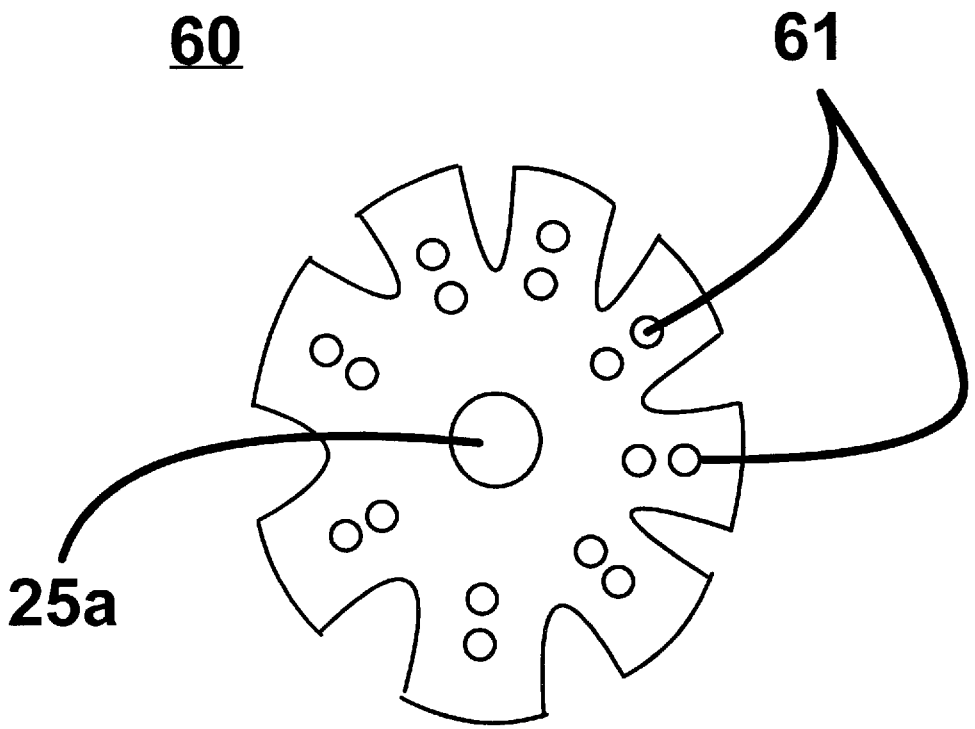
FIG. 6 is a frontal view of an optional end-cap which can be placed over the end of the core-chuck device as shown in FIG. 2, to further secure each interchangeable-fin from movement.

An optional element to be used with the preferred embodiment of the present invention is shown in FIG. 6. This optional element is an end-cap 60 that would be placed over the flange 27 on the support sleeve 26 and attach to the outermost exposed surfaces of the core-chuck device 20 which is seen in FIG. 2. When the end-cap 60 is attached, the flange 27 of the support sleeve 26 is located between the end-cap 60 and central hub 24. While the dovetail connections between the central-hub 24 and each interchangeable-fin 21 is normally sufficiently secure during the single-use of the core-chuck device 20 during paper manufacturing, multiple re-use of the core-chuck device 20 involving removal and re-insertion of the core-chuck device 20 may cause longitudinal migration of one or more of the interchangeable-fins 21 with respect to the central-hub 24. Securing the interchangeable-fins 21 together reduces such migration during multiple re-use of the core-chuck device 20. This is accomplished by using some suitable fastening means (e.g., screws, tacks, or adhesive) to attach the end-cap 60 to each interchangeable-fin 21. Screws (not shown) are the preferred method of fastening as they are easily removed for changing of the interchangeable-fins 21 as needed. Through-holes 61 are provided for such fastening means in the form of screws. Also, a central-aperture 25*a* is provided within the end-cap 60 which substantially conforms to the core-chuck-aperture 25 as seen in FIGS. 2, 3, and 5.

It should be understood that the preferred embodiment mentioned here is merely illustrative of the present invention. While specific materials are disclosed and a specific number of interchangeable-fins and related channels are shown, this is not meant to be limiting. Numerous variations in design and use of the present invention may be contemplated in view of the following claims without straying from the intended scope and field of the invention herein disclosed.

I claim:

1. A core-chuck device comprising:

a) a central-hub having an outer-surface and an inner-surface; said outer surface including a plurality of longitudinally oriented channels, said channels being substantially parallel to a rotational axis of said central hub;

b) a support-sleeve, wherein said inner-surface is capable of receiving said support-sleeve; and c) a plurality of interchangeable-fins, each having a longitudinally oriented protrusion, each said protrusion being tightly engageable with each of said channels;

wherein said core-chuck device can be held tightly within a core upon engagement of said plurality of interchangeable-fins with said central-hub.

2. The core-chuck device as claimed in claim 1, wherein said channels and said protrusions are matingly formed in a respective dovetail-shape such that each said protrusion is slidingly securable within one of each said channels.

3. The core-chuck device as claimed in claim 2 wherein each of said interchangeable-fins includes a tapered-section and a portion exhibiting reduced mass.

4. The core-chuck device as claimed in claim 3 wherein said reduced mass portion includes a hollowed-out-section and a thinned-section surrounding said hollowed-out-section.

5. The core-chuck device as claimed in claim 4 wherein an end-cap is fastened to a base-end of each of said interchangeable-fins.

6. The core-chuck device as claimed in claim 5 wherein said central-hub, each said interchangeable-fins, and said end-cap are made from a durable plastic material.

7. The core-chuck device as claimed in claim 5 wherein said central-hub is made from ultra-high-molecular-weight polymer.

8. The core-chuck device as claimed in claim 5 wherein said support-sleeve is provided in the form of a metallic cylinder having a circumferential flange.

9. The core-chuck device as claimed in claim 8 wherein said support-sleeve is made from aluminum.

10. The core-chuck device as claimed in claim 9 wherein said circumferential flange is located between said end-cap and said central-hub.

11. The core-chuck device as claimed in claim 9 wherein said circumferential flange is located externally of said end-cap.

12. A method of using a core-chuck device within a paper-roll having a core, said core having a first end and a second end, said core-chuck device having a) a central-hub having an outer-surface and an inner-surface, said outer-surface including a plurality of longitudinally oriented channels;

b) a support-sleeve having a circumferential flange, wherein said inner-surface is capable of receiving said support-sleeve; and c) a plurality of interchangeable-fins, each having a longitudinally oriented protrusion, each said protrusion being tightly engageable with each of said channels, said method comprising the steps of:

a) selecting a set of said plurality of interchangeable-fins, said set chosen based on a core dimension of said paper-roll;

b) inserting each said protrusion of an interchangeable-fin from said predetermined set into one of said channels;

c) inserting said support-sleeve into said inner-surface of said central-hub; and d) inserting said interchangeable-fins that are engaged with said channels into said first end of said core of said paper-roll.

13. The method as claimed in claim 12, wherein said steps of selecting a set of plurality of interchangeable fins, inserting each protrusion of each of said interchangeable-fins, and inserting said support-sleeve into said inner surface of said central-hub are repeated to form a second core-chuck and further including the step of inserting said interchangeable-fins that are engaged with said channels of said second core-chuck into said second end of said core.

14. The method as claimed in claim 13 wherein each of said interchangeable-fins includes a tapered-section and a portion exhibiting reduced mass.

15. The method as claimed in claim 14 wherein said reduced mass portion includes a hollowed-out-section and a thinned-section surrounding said hollowed-out-section.

16. The method as claimed in claim 15 further including the step of fastening an end-cap to each set of interchangeable-fins.

17. The method as claimed in claim 16 wherein said central-hub, each said interchangeable-fin, and each said end-cap are made from a durable plastic material.

18. The method as claimed in claim 17 wherein said central-hub is made from ultra-high-molecular-weight polymer.

19. The method as claimed in claim 18 wherein said support-sleeve is provided in the form of a metallic cylinder having a circumferential flange.

20. The method as claimed in claim 19 wherein said support-sleeve is made from aluminum.

* * * * *